US005766086A

United States Patent [19]

Folsom

[11] Patent Number: 5,766,086

[45] Date of Patent: Jun. 16, 1998

[54] GOLF GAME

[76] Inventor: Miki William Folsom, 198 Williamson Dr., Macon, Ga. 31210

[21] Appl. No.: 758,922

[22] Filed: Dec. 8, 1996

[51] Int. Cl.[6] ..... A63B 67/02

[52] U.S. Cl. ..... 473/185; 473/176; 473/196; 473/172

[58] Field of Search ..... 473/169, 170, 473/171, 172, 173, 174, 175, 176, 180, 185, 195, 196; 206/315.2; 273/400, 402

[56] References Cited

U.S. PATENT DOCUMENTS

| | | | |
|---|---|---|---|
| 2,849,238 | 8/1958 | Eldredge | 473/180 |
| 3,797,833 | 3/1974 | Rokusek | 473/180 |
| 4,878,671 | 11/1989 | Gubany | 473/185 |
| 5,029,856 | 7/1991 | Bookspan | 473/175 |
| 5,383,665 | 1/1995 | Schultz et al. | 473/169 |
| 5,575,483 | 11/1996 | Dineen et al. | 473/170 |

*Primary Examiner*—Mark S. Graham
*Attorney, Agent, or Firm*—Harry I. Leon

[57] ABSTRACT

A portable golf game apparatus with multiple targets which are individually identifiable by symbols in a recognizable sequence marked thereon. Prior to a game, the targets are placed, in successive relationship, in a playing field. The targets include cups, the upper edges thereof being disposed level with the surface of the ground during play. Flags and markers are deployed to help guide players through the sequence of the cups to be played and to supply information as to the direction the ball needs to be struck to reach the next cup. Means for removably mounting one of the flags on each of the cups is provided; the markers, on the other hand, are self-supporting. After the game, the cups are removed and stored together. Stackable, the cups can be placed end to end form a hollow tube. End caps can be secured to the tube so as to close it. The resultant closed container can then be used to store a putter and golf balls as well as the flags and markers.

6 Claims, 4 Drawing Sheets

FIG. 7.
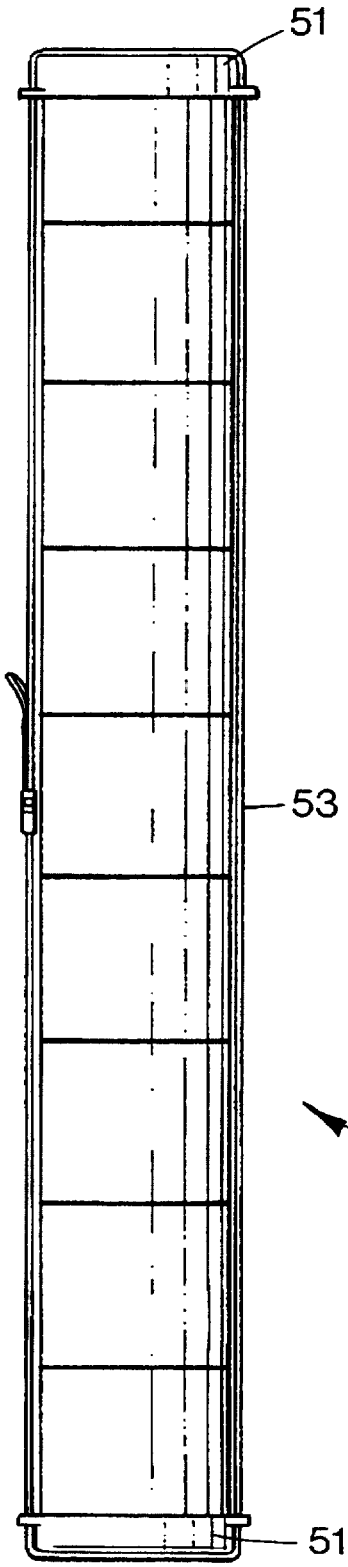
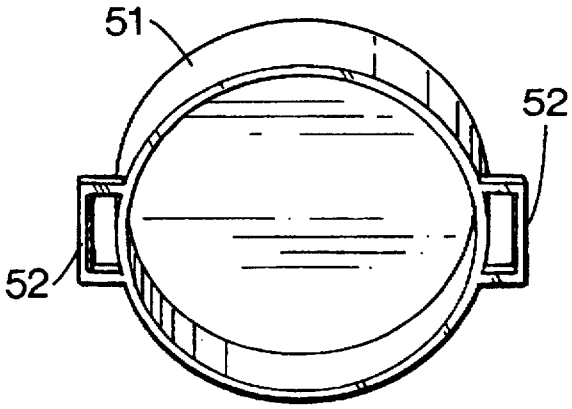
FIG. 8.
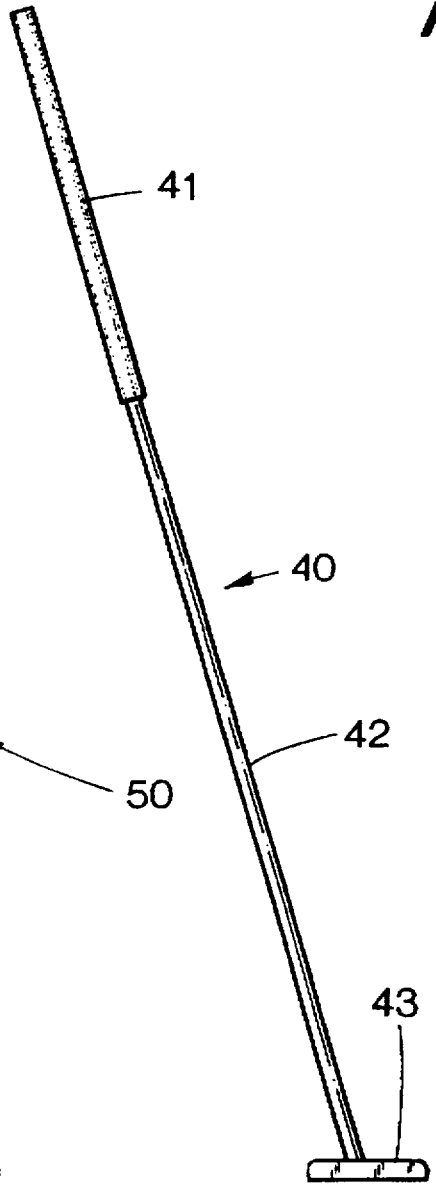
FIG. 4.

GOLF GAME

BACKGROUND OF THE INVENTION

This invention relates to the game of golf, a popular sport for centuries. Played with a resilient ball and one or more clubs, the game has as its object getting the ball into a series of holes or cups in the least number of hits or strokes. Golf is usually played on a large grassy area (course), with a typical 9 hole course in the United States occupying about 65 acres and an 18 hole course, 150 acres. The clubs, which can vary in material, shape and size, are selected according to the distance the ball needs to be moved and the conditions of the course. In the area around each hole commonly known as a green, golfers use a straight-faced club called a putter.

SUMMARY OF THE INVENTION

The object of this invention is to provide apparatus for a game of golf which can be played on an unpaved surface of virtually any size.

A further object of this invention to provide golfers with equipment which they can use, at convenient locations, to practice putting.

A still further object of this invention is to provide a game which people of all ages and ability can enjoy playing.

In accordance with the present invention, there is provided apparatus for a portable golf game. Game pieces include a set of multiple targets, each target comprising a flag and an open-ended, generally cylindrical cup having an upper inner diameter which is approximately the same as that of a hole in a conventional golf game. The flag comprises a pole and an indicator. The pole, one end of which is removably mountable within the cup, protrudes vertically from the cup. The indicator, which preferably comprises means for displaying a number or letter of the alphabet, is affixed to the distal end of the pole. Alternatively, the indicator is color-coded.

Besides the targets, the game pieces include conventional golf balls and putting clubs. Also, in the preferred embodiment, markers for directing the player to the next cup in a series to be played are employed. The markers are equipped with pointed supports easily be insertable into the ground.

Stackable, the cups can be arrayed, end on end, to form an open tube. To facilitate transporting and storing the targets and other game pieces, a pair of caps is also provided. The caps can be slipped over the top and bottom edges, respectively, of the stack of cups so as to form a closed container. Means for holding the caps in position at the ends of the stack comprises a strap which is also useful in carrying it.

When, as in the preferred embodiment, nine cups are stacked together with the top and bottom caps, the closed container so formed can be used to store 9 flags and 9 markers as well as one or two conventional golf clubs and at least two golf balls.

In use, the targets are temporarily anchored in the ground, buried sufficiently so that the top edge of each cup is level with the ground surface. Preferably, a lawn, beach or the like serves as a playing field, somewhat resembling one of the greens on a golf course. For convenience, the targets are preferably distributed in the playing field so as to describe a somewhat circular path. With such a pattern, the final hole can be located close to the starting point. A marker is placed close to each hole so that after it has been played, this proximate marker points to the next hole to be played.

BRIEF DESCRIPTION OF THE DRAWINGS

FIG. 4 is a perspective view, on a reduced scale, of a club which can be used as part of the game apparatus according to the present invention;

FIG. 7 is a side elevation view, on a reduced scale, of a stack of containers according to FIG. 1, the stack being closed, at its upper and lower ends, by a pair of end caps; and FIG. 8 is a perspective view, on an enlarged scale, of one of the end caps according to FIG. 7.

DETAILED DESCRIPTION OF THE PREFERRED EMBODIMENT

Figure 1:
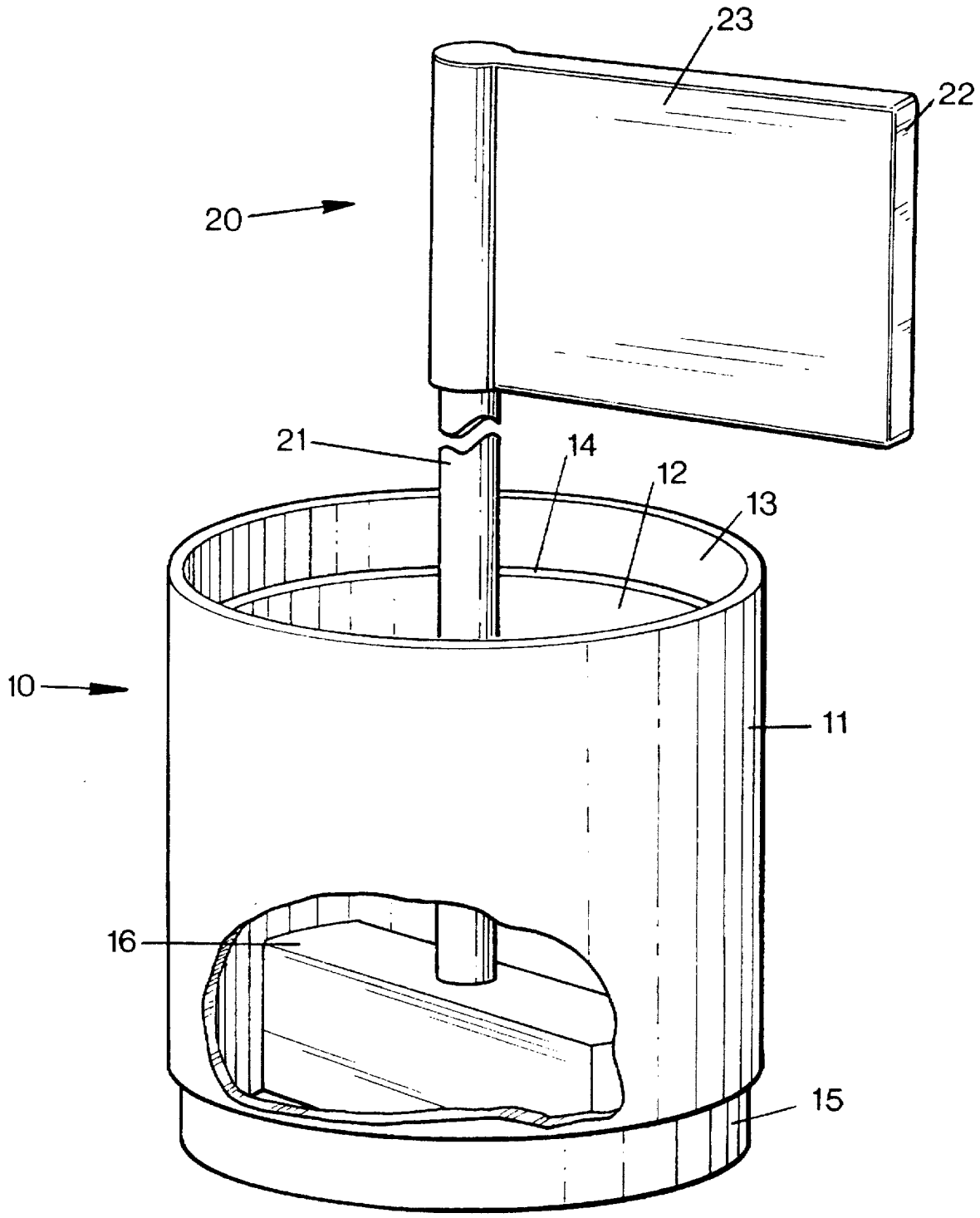
FIG. 1 is a perspective view of a container with a flag mounted thereon, part of the golf game apparatus according to the present invention, the container being illustrated in part, with a breakaway section thereof showing the flag support.
Figure 2:
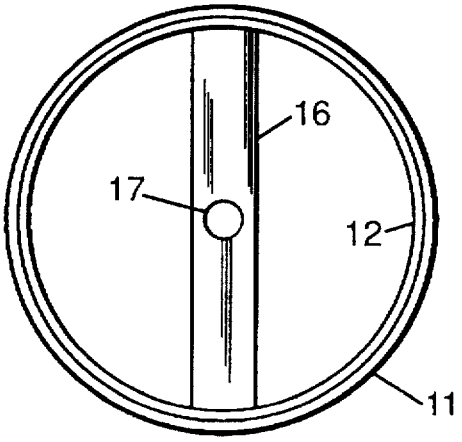
FIG. 2 is a plan view of the container according to FIG. 1, with the flag removed.
Figure 3:
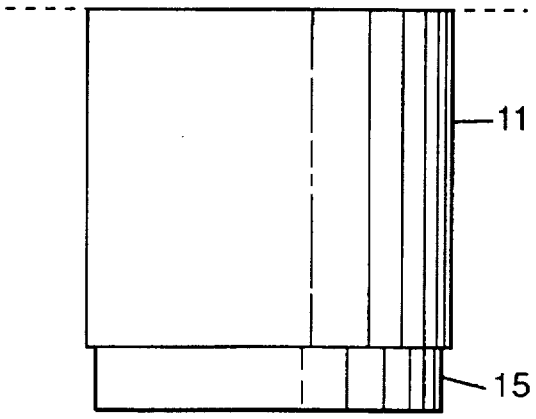
FIG. 3 is a side elevation view of the container according to FIG. 1, the container being shown in an upright position with the flag removed.

Referring now to the drawings, a target in a portable golf game according to the present invention includes a cup and flag indicated generally by the reference numerals 10 and 20, respectively. Preferably, the cups 10 are fabricated of plastic and have a wall thickness which measures, by way of example, ⅛ inch. Cups 10 formed of metal are also acceptable and can have thinner walls than do plastic cups. Each cup 10 has an upper inner diameter of about 4 inches and an overall height of about 6 inches, similar to a conventional golf cup. In its preferred embodiment, the golf game utilizes nine targets 10.

To facilitate storing and transporting game pieces, the cups 10 are formed so that they can be stacked together. Each cup 10 has a wall 11 defining an upper ridge 13 and an interior cylindrical surface 12 which terminates at an upper shoulder 14. The ridge 13, which is of reduced thickness relative to the remainder of the wall 11, extends upwardly from the shoulder 14. Distal from the ridge 13, the wall 11 defines a radial cutout surface 15 which terminates along a lower shoulder. In transverse cross-section, the cutout surface 15 has an approximately circular outer periphery and is of slightly less diameter than is the upper inner diameter of the cup 10. Extensions of the cutout surface 15 and of the ridge 13 in the longitudinal direction are such that the bottom of a first cup 10 can be fitted on top of a second cup 10, with the bottom edge of the first cup resting on the shoulder 14 of the latter, making the cups stackable.

In addition, at least one cap 51 which can be removably slipped past the portion of the wall 11 which defines the radial cutout surface 15 is also provided. A container 50 can be formed by stacking the cups 10 together and inserting the lower end of the open tube so formed into the cap 51.

In the preferred embodiment, each cap 51 also includes a pair of slotted tabs 52 which extend laterally therefrom. With the use of the tabs 52 and a strap 53 inserted through the slots formed therein, a pair of caps 51 can be held in place so as to close the distal ends of the container 50 (FIG. 7). In use, the strap 53 not only holds the container 50 closed but also serves as an aid in carrying it.

As is best seen in FIG. 1, means for mounting the flag 20 comprises a bracket 16 disposed proximate with the bottom of each cup 10. The bracket 16, which is fixedly attached to the wall 11, defines a hole 17 centered within the cup 10 and sized to removably receive the lower end of the flag pole 21. In the preferred embodiment, the flag 20, with its indicator 22 fastened thereto, is about 3 feet in length. The indicator 22, which is preferably formed of rigid plastic, includes means for signalling the position of a target in a series of holes to be played. Alternatively, the indicator 22 can be fabricated of a flexible material. The signalling means can be either a numerical or alphabetic symbol displayed on a vertical surface 23 of the flag 20. The indicator 22 can also be colored coded.

In the preferred embodiment, the game is played with a club 40 which comprises three parts: a foam handle 41, a shaft 42 and a club head 43. Alternatively, a conventional golf putter can be utilized. In the club 40, the handle 41 by itself measures, by way of example, 10 inches long; the shaft 42 with handle, 30 inches long; and the club head 43, 1 inch high, 3 inches wide and ½ inch thick. The club head 43 can be constructed either of metal or plastic.

Figure 5:
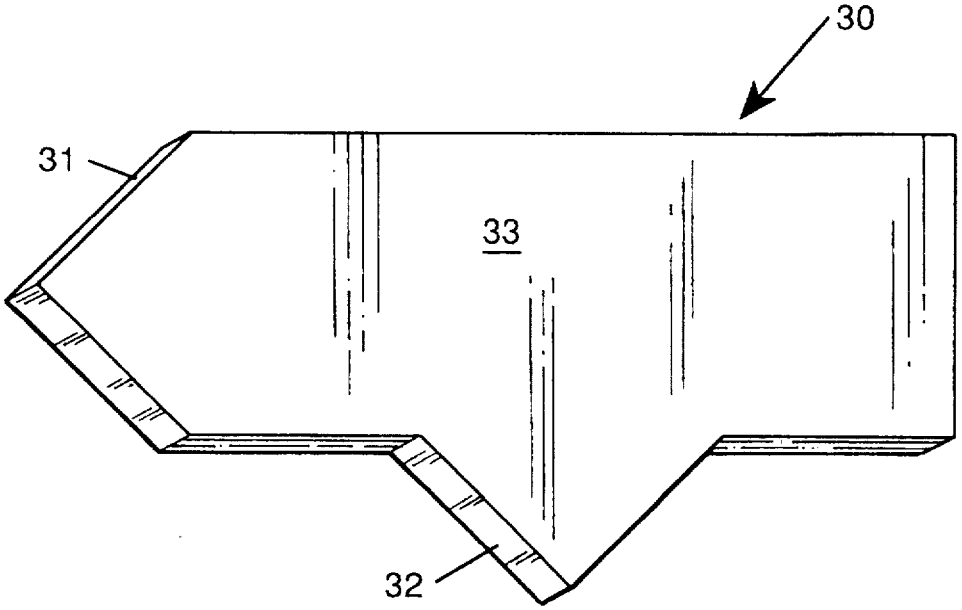
FIG. 5 is a perspective view of a typical marker for use as part of the game apparatus according to the present invention.
Figure 6:
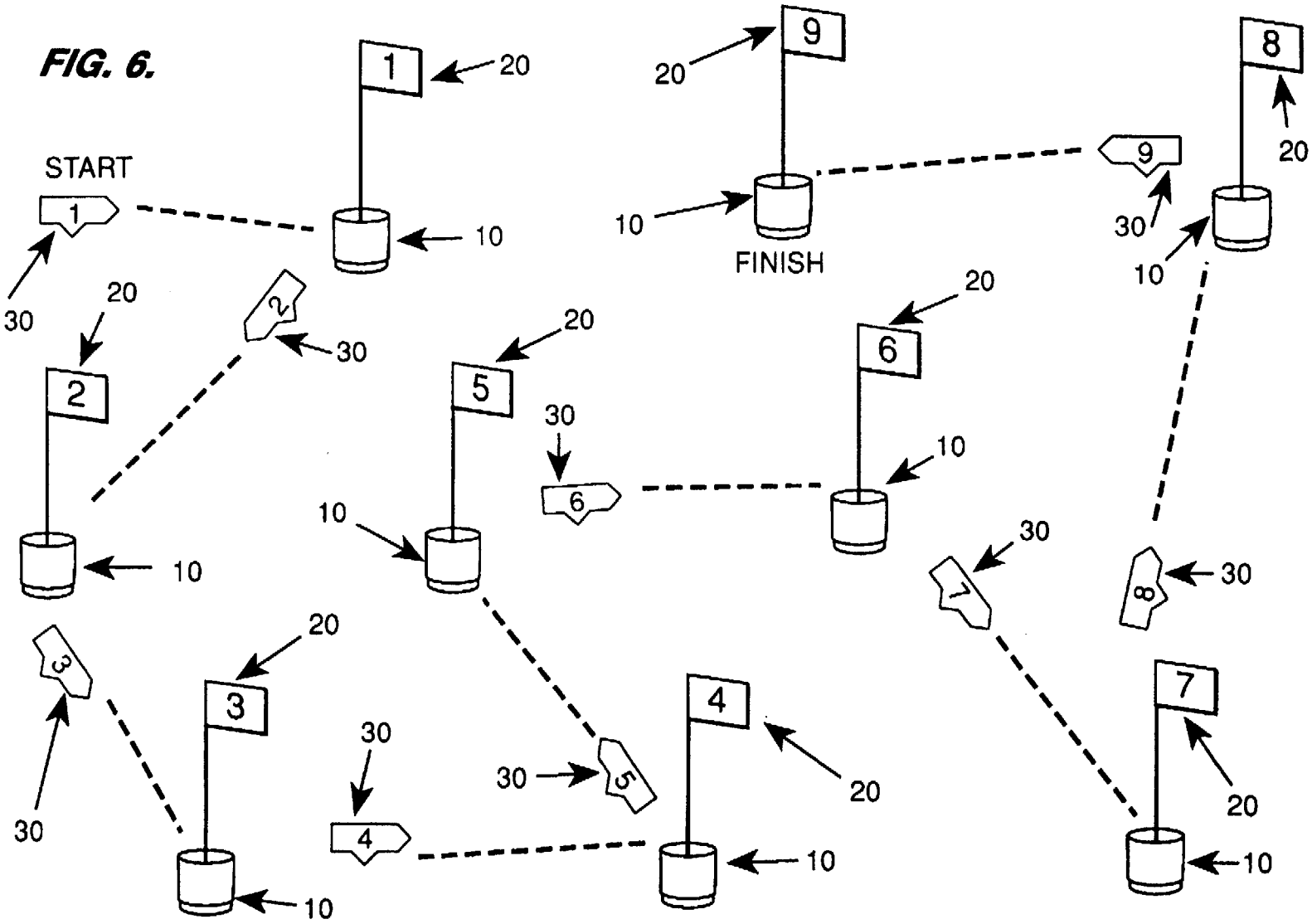
FIG. 6 is a schematic showing the layout of a typical playing field on which the containers according to FIG. 1 have been installed.

Optional game pieces include markers 30 (FIG. 5). In the preferred embodiment, each marker 30 defines an arrow 31 and a stake-like point 32 disposed perpendicularly to the arrow to hold the marker in the ground. As illustrated in FIG. 6, the markers 30 are positioned on a playing field between the holes 10 so as to indicate the next hole in a series to be played. Side surfaces 33 of the markers 30 preferably display symbols or are color-coded in a manner which is consistent with that used for the respective flag indicators 22 (FIG. 6).

A portable golf game according to the present invention preferably utilizes nine cups 10 and nine markers 30, but any number of cups can be used for the game. In FIG. 6, there is shown a schematic layout of one of many possible configurations of the game using nine cups 10. The game is won by hitting, with the least number of strokes, a golf ball generally in the direction of the dashed lines shown in FIG. 6 and in sequence to each cup 10.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. Portable golf game apparatus, comprising:

(a) at least two targets, the targets including first and second cups and a pair of flags, each flag being individually identifiable; each cup defining a hollow, generally cylindrical cavity and means for removably holding one of the flags in an upright position;

(b) the second cup having an annular shoulder, a portion of the first cup being slideably insertable into the cylindrical cavity of the second cup, said portion abutting the shoulder when fully inserted into the second cup, thereby making the first and second cups stackable; the cups, when stacked, defining an elongated open tube; and (c) at least one end cap, a portion of the second cup distal from the shoulder being slideably insertable into the end cap, so that at least one end of the tube can be closed; the end cap and the first and second cups forming a single, portable container.

2. The apparatus according to claim 1 which further comprises at least two markers, each marker having means for indicating the next cup in a series to be played.

3. A portable golf game apparatus, comprising:

(a) multiple cups, each cup defining an upper edge and a hollow, generally cylindrical cavity about the size of a conventional golf hole; the cups being stackable to form an elongated hollow tube; and (b) means, including a pair of end caps, for closing both ends of the tube; the caps and stacked cups together forming a closed container.

4. The apparatus according to claim 3, which further comprises multiple flags, the flags being individually identifiable from symbols in a recognizable sequence marked thereon, each of the cups having means for holding a flag so that the cups can be positioned and played in successive relationship; in use, the cups being removably anchored with the upper edges thereof disposed at ground level.

5. The apparatus according to claim 3, which further comprises markers, each individual marker being individually identifiable with one of the flags, each marker being positioned proximate with one of the cups and having means for indicating the next cup in sequence to be played and its direction.

6. The apparatus according to claim 5, wherein the indicating means includes an arrow and each marker further comprises support means for mounting it in dirt, the marker being formed of a single unitary structure formed of plastic.

* * * * *